US005471807A

United States Patent [19]

Vasquez

[11] Patent Number: 5,471,807

[45] Date of Patent: Dec. 5, 1995

[54] ROOFING SYSTEM EMPLOYING GROOVED BATTEN MEMBER

[76] Inventor: Daniel E. Vasquez, 1049 Kimball Ave., Seaside, Calif. 93955

[21] Appl. No.: 162,343

[22] Filed: Dec. 3, 1993

[51] Int. Cl.[6] ..... E04D 1/30

[52] U.S. Cl. ..... 52/553; 57/478; 57/551

[58] Field of Search ..... 52/553, 551, 726.1, 52/478, 747, 24, 25, 26, 408, 409, 730.7, 550, 302.1, 302.3

[56] References Cited

U.S. PATENT DOCUMENTS

| | | | |
|---|---|---|---|
| 1,163,034 | 12/1915 | Phippen | 57/302.1 X |
| 4,437,283 | 3/1984 | Benoit . | |
| 4,445,306 | 5/1984 | Schauffele . | |
| 4,662,141 | 5/1987 | Miko | 52/553 |
| 4,712,349 | 12/1987 | Riley et al. | 52/408 |
| 4,718,211 | 1/1988 | Russell et al. . | |
| 5,060,445 | 10/1991 | Jong | 52/553 |
| 5,161,342 | 11/1992 | Hasan et al. . | |
| 5,197,252 | 3/1993 | Tiscareno | 52/553 |

*Primary Examiner*—Carl D. Friedman
*Assistant Examiner*—Creighton Smith
*Attorney, Agent, or Firm*—Laura J. Zeman

[57] ABSTRACT

A roofing system which employs grooved batt members. The grooves ran across the width of the batt members on a back side of the batt members and are longitudinally spaced along the length of the batt members. The grooved sides of the batt members are placed adjacent to the top of the roof structure to allow water and other liquid elements to drain through the batt members and off of the roof structure.

13 Claims, 1 Drawing Sheet

ROOFING SYSTEM EMPLOYING GROOVED BATTEN MEMBER

BACKGROUND OF THE INVENTION

The present invention relates generally to a roofing system employing grooved batt members. More particularly, the present invention relates to a roofing system in which plastic batts are used to secure a single-ply membrane or cover material, such as felt paper, to the entire roof area. The plastic batts comprise a series of longitudinally spaced grooves which run across the width of the batts, at predetermined distances along the length of the batts, on that side of the batts which are in contact with the roof area and cover material. Tiles are layered and attached to the batts after fastening the batts to the roof area in order to secure the cover material to the roof area.

Roofing systems that utilize batts or fastening strips to hold roof coverings in place are well known in the art. For example, U.S. Pat. No. 4,437,283 describes a single-ply roofing system having a roof sheet which is attached to a roof with batten sealing members. Each batten sealing members includes a batten which is secured to the roof by fasteners, and a composite sealing member which is placed over the batten and fasteners. The composite sealing member increases bonding strength over time and undergoes a self vulcanizing-like process with the roof sheet to encapsulate the batten between the roof sheet and the composite sealing member. U.S. Pat. No. 5,161,342 describes a fastening system in which plastic fastening strips are used to affix a building member to a substrate. The plastic fastening strips have substantially planar top and bottom surfaces with no longitudinally extending thickened portions or ribs so that the bending of the strips along a transverse line is not restricted. At least two of the batten strips are superimposed on one another and then fastened to the substrate or membrane with fasteners.

U.S. Pat. No. 4,445,306 discloses a mechanically attached roofing system comprising a flexible waterproof membrane which covers an entire roof area and elongated fastening bars, made of resilient plastic material, which are secured to the top of the membrane at periodically spaced intervals. The system further comprises self adhering waterproof strips which surround the elongated fastening bars and fasteners which are driven through the waterproof strips, fastening bars, and membrane, and into the deck area of the roof. U.S. Pat. No. 4,718,211 describes a batten bar for a single ply membrane used on roofs. The batten bar is comprised of an extrudable plastic and has thick side portions which are connected by a bridging portion which has a thickness less than the side portions. The bridging portion is displaced between the side portions to form an upper and lower elongated groove which runs the length of the batten bar. The upper groove is deeper and more defined than the lower groove. The batten bar is attached to a roof membrane by securing fasteners, such as screws, through the bridging portion of the batten bar such that the lower groove of the batten bar is in intimate contact with the roof membrane in at least three different areas. The tops of the fasteners, or screws, are seated within the upper groove of the batten bar to enable another single-ply membrane, similar to the roof membrane, to cover the batten bar without the risk of abrasions or penetrations from the fasteners.

Batten bars are comprised of numerous materials including metal, aluminum, wood, and plastic. However, the main objective with respect to the configuration and composition of batten bars has been to provide a batten bar which is durable, non-deformable, and able to accommodate a moisture proof seal in order to enhance its durability.

Accordingly, there are no roofing systems which employ batts, and in particular plastic batts, having grooves which facilitate the drainage of water from the roof. Such a system avoids water leakage through the roof membrane, and ultimately the roof itself, at those points along the joinder of the batts and roof membrane where water may collect due to the orientation and positioning of the batts. This drainage of water from the roof allows for an extended life expectancy of the roof and underlying structure due to deterioration caused by water.

SUMMARY OF THE INVENTION

It is a principal object of the present invention to provide a roofing system which extends the functional lifetime of a roof.

It is a further object of the present invention to provide a roofing system which facilitates drainage from the surface of the roof and enhances the durability of the roof and the component parts of the roofing system.

It is still a further object of the present invention to provide a simple and cost effective method for extending the functional lifetime of a tile or similar type of roof.

It is yet a further object of the present invention to provide an improved batt member which can be used in a variety of roofing systems to facilitate the removal of water and thereby limit the absorption and penetration of the water into the roof and roof membrane.

Accordingly, the inventive roofing system includes a water resistant roof membrane, which is positioned over the entire area of a roof, and a plurality of batt members each having grooves running perpendicular to the length of the batt member, and spaced at predetermined intervals along the length of the batt member. The grooves are cut into the batt member on that side of the batt member which is placed directly on top of the roof membrane. The batt members are horizontally aligned on top of the roof membrane and then fastened to the roof membrane with the grooves in the batt members facing downward on top of the roof membrane.

The objects and advantages of this invention will appear more fully from the following more detailed description of the preferred embodiments of the invention taken with reference to the accompanying drawings.

DETAILED DESCRIPTION OF THE DRAWINGS

Figure 1:
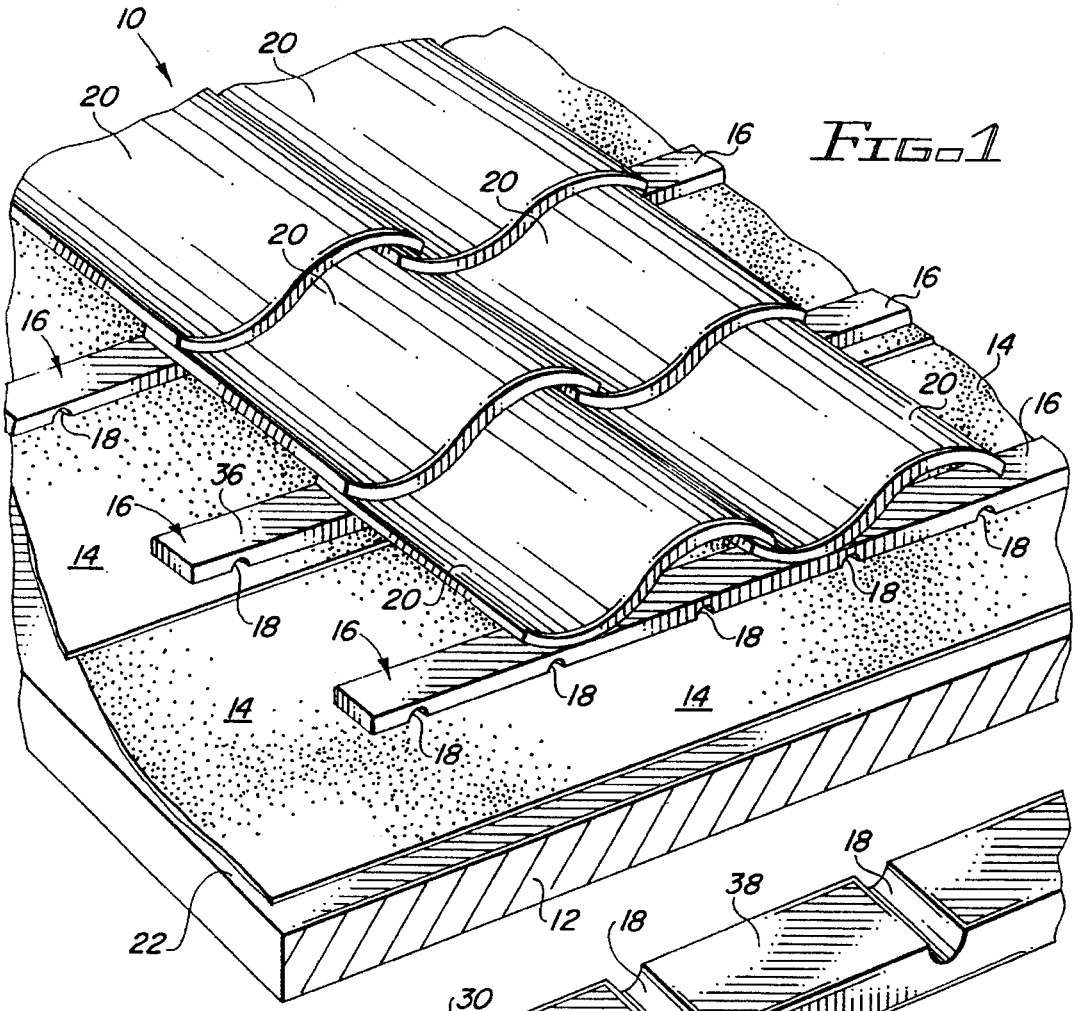
FIG. 1 is a fragmentary perspective view of the roofing system constructed in accordance with the present invention.

With reference now to FIG. 1, there is shown a perspective view of the roofing system 10 assembled in accordance with the present invention. The roofing system 10 comprises a roof structure 12, a roof membrane 14, batt members 16 having vertically cut grooves 18, and roofing tiles 20. The roof membrane 14 is placed over the roof surface 22 of the roof structure 12 such that the entire area of the roof surface 22 is covered with at least one layer of the roof membrane 14. The roof membrane 14 may comprise one single sheet or several single-ply sheets which are aligned with one another to cover the entire roof surface 22 with one layer of roof membrane 14. The roof membrane 14 is preferably comprised of felt paper or any other similar type of durable single-ply sheet material.

A plurality of batt members 16 are then positioned on top of the roof membrane 14 such that the most lengthwise aspect of each batt member 16 is aligned horizontally with respect to the plane of the roof structure 12. The plurality of batt members 16 are generally evenly spaced and aligned over the entire area of the roof membrane 14 so that the entire roof membrane 14 will be attached to the roof structure 12 upon securing each of the plurality of batt members 16 to the roof structure 12.

Figure 2:
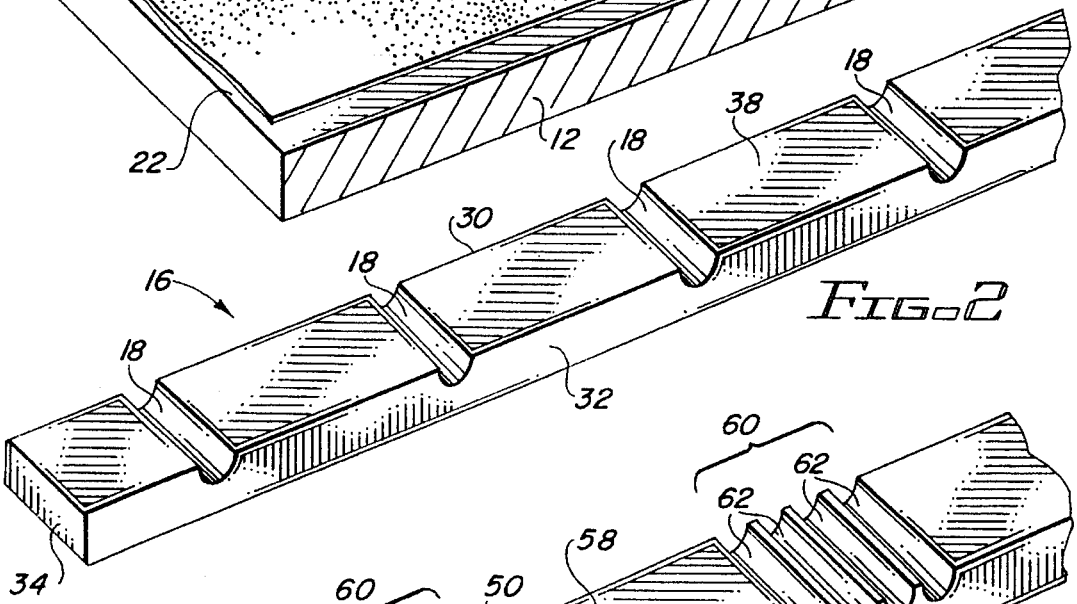
FIG. 2 is a fragmentary perspective view of a first preferred embodiment of a batt member comprising part of the roofing system in accordance with the present invention.

As shown in FIG. 2, one preferred embodiment of each of the batt members 16 comprises a generally elongated rectangular configuration having a top end 30, a bottom end 32, side ends 34, a front side 36 (See FIG. 1), and a back side 38. The back side 38 of the batt members 16 further comprise a series of grooves 18 which are cut along the width of the back side 38 of the batt members 16 and perpendicular to the length of the batt members 16.

The batt members 16 are preferably comprised of sturdy, durable, and weather-resistant reprocessed plastic materials such as polyvinylchloride, polyethylene, polypropylene, polycarbonate, nylon, and polyesters. The reprocessing of the plastic material to produce the batt members 16 aids the environment by providing a use for discarded plastic objects, eliminating the need for excess energy and materials to produce new plastics, and reducing the amount of landfill space needed for discarded objects made of plastic materials.

However, the composition of the batt members 16 is not limited to recyclable plastics. The batt members 16 may also be comprised of wood, metal, or any other material which can accommodate the cutting of grooves 18 along the width of the back side of the batt members 16 and perpendicular to the length of the batt members 16.

Further, the batt members 16 are preferably formed in approximately four foot lengths by molding or ram extruding the durable and resilient plastic material wherein the batt members 16 are approximately one and one-half inches in width and approximately three-quarter inches in height. Alternatively, the plastic batt members 16 may be cut from large plastic sheets and then carved or cut to form grooves 18 within the batt members 16. In addition, the grooves 18 in the batt members 16 are approximately one-quarter inch in width and approximately three-sixteenth inches in depth. Each batt member 16 preferably contains sixteen grooves 18 which are spaced approximately three inches apart from one another to facilitate the most efficient mechanism for draining water or other solvents from the roof surface 22. However, the number of grooves 18 in the batt members 16 will depend on the drainage efficiency one is trying to achieve with the roofing system.

Returning now to FIG. 1, the back sides 38 of the batt members 16 having grooves 18 are placed down on top of the roof membrane 14 such that the connection of the grooves 18 with the roof membrane 14 form tunnels which can function as drain passageways for water and other solvents which come in contact with the roof structure 12. The batt members 16 are secured to the roof membrane 14 and roof structure 12 by nails or screws which are forced through the batt members 16 and into the roof structure 12. Once the batt members 16 are secured to the roof membrane 14 and roof structure 12, roofing tiles 20 or other similar types of roof coverings may be secured to the front side 36 of the batt members 16 by a suitable means of attachment such as nails.

Upon completion of the roofing system, water or other liquid materials may enter through the roofing tiles 20 or through the spaces or gaps existing between the roofing tiles 20 and come into contact with the roof membrane 14. The spacing of the grooves 18 in the batt members 16, as previously described with reference to FIG. 2, serves to redirect the water which is collected at the junction of the top ends 30 of the batt members 16 and the roof membrane 14 by routing it through the tunnels created by the grooves 18 in the batt members 16 and off of the roof structure 12.

Figure 3:
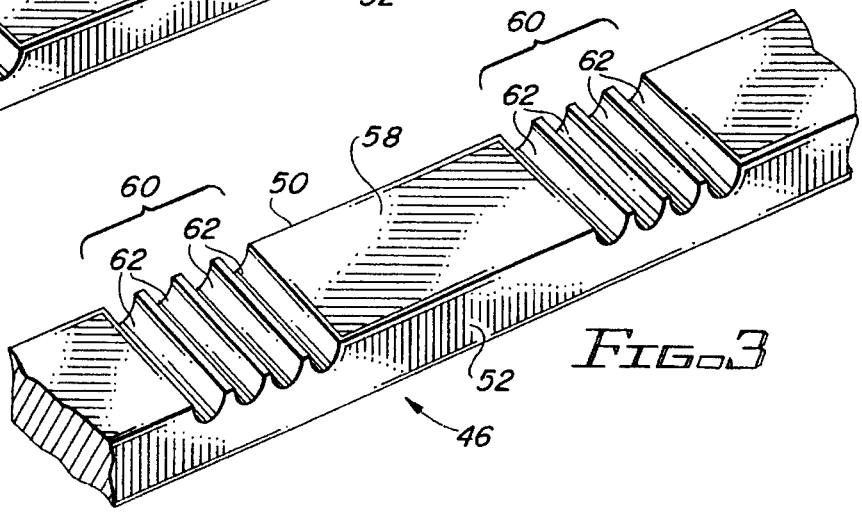
FIG. 3 is a fragmentary perspective view of a second preferred embodiment of a batt member comprising part of the roofing system in accordance with the present invention.

Turning now to FIG. 3, there is illustrated a fragmentary view of a second preferred embodiment of the batt member 46 which comprises part of the roofing system 10 in accordance with the present invention. Like the first preferred embodiment of the batt member 16, the second preferred embodiment of the batt member 46 comprises a top end 50, a bottom end 52, side ends (not shown), a front side (not shown), and a back side 58. The batt member 46 further comprises a plurality of groove sets 60 which each comprise a plurality of individual grooves 62. This embodiment of the batt member 46 of the present invention functions to increase the efficiency of the drainage system created by the grooves 62 in the batt members 46 of the inventive roofing system.

While preferred embodiments of the invention have been shown and described, it will be apparent to those skilled in the art that various modifications may be made in these embodiments without departing from the spirit of the present invention. For that reason, the scope of the invention is set forth in the following claims.

I claim:

1. A roofing system which facilitates drainage and enhances durability of a roof comprising:

a water resistant roof membrane positioned over an entire area of the roof;

at least one water resistant batt member having a front side; a back side, and a plurality of grooves running along a width of the back side of said batt member, said plurality of grooves being located at predetermined spaces along a length of said batt member; and means for fastening said back side of said batt member to said roof membrane.

2. The roofing system of claim 1, further comprising a plurality of tile members secured to said at least one batt member.

3. The roofing system of claim 1 wherein said at least one batt member comprises a plurality of generally rectangular shaped batt members, wherein said plurality of generally rectangular shaped batt members are horizontally positioned over said roof membrane.

4. The roofing system of claim 1 wherein said at least one water resistant batt member is comprised of a sturdy and resilient plastic material.

5. The roofing system of claim 1 wherein said means for fastening said back side of said batt member to said roof membrane comprises at least one of a plurality of screws and a plurality of nails located along a length of said batt member.

6. The roofing system of claim 1 wherein said plurality of grooves comprise sets of grooves wherein each set of grooves comprises a plurality of individual grooves.

7. A batt member, positioned between a roof membrane and a plurality of tile members, comprising a top end, a bottom end, two side ends, a front side, and a back side, said back side of said batt member lying adjacent to said roof membrane and comprising a plurality of grooves running across a width of said batt member and said front side of said batt member lying adjacent to said plurality of tile members.

8. The batt member of claim 7 wherein said batt member is generally rectangular in shape.

9. The batt member of claim 7 wherein said plurality of grooves are located along a length of said batt member.

10. The batt member of claim 9 wherein said plurality of grooves comprise sets of grooves wherein each set of grooves comprises a plurality of individual grooves.

11. The batt member of claim 7 wherein said batt member is comprised of a sturdy and resilient plastic material.

12. A method for draining water and other solvents from a roof structure and thereby enhancing durability of the roof structure comprising the steps of:

positioning a roof membrane over an entire area of the roof structure;

positioning a plurality of batt members having grooves over an entire area of the roof membrane; and securing said plurality of batt members to said roof membrane and said roof structure such that said grooves are in contact with said roof membrane.

13. The method according to claim 12, further comprising the step of attaching at least one of a plurality of tile members and a plurality of roof cover members to said plurality of batt members.

* * * * *